US006019225A

United States Patent [19]

Kalmakis et al.

[11] Patent Number: 6,019,225

[45] Date of Patent: Feb. 1, 2000

[54] PIPETTE TIP RACK WITH ARRAY OF INTERCONNECTED SLEEVES

[75] Inventors: George P. Kalmakis, Reading, Mass.; Victor A. Torti, Brookline; Dan Seguin, Amherst, both of N.H.; Robert H. Zier, Annapolis, Md.; Gary E. Nelson, Hollis, N.H.

[73] Assignee: Matrix Technologies Corp., Hudson, N.H.

[21] Appl. No.: 09/178,697

[22] Filed: Oct. 26, 1998

[51] Int. Cl.[7] ..... B65D 1/34

[52] U.S. Cl. ..... 206/563; 206/443; 211/74; 422/102

[58] Field of Search ..... 206/443, 486, 206/562, 563, 569; 211/74; 422/99, 100, 104, 102; D24/227, 229, 230; 156/73.1

[56] References Cited

U.S. PATENT DOCUMENTS

| | | | |
|---|---|---|---|
| D. 271,239 | 11/1983 | Lemieux et al. . | |
| D. 282,208 | 1/1986 | Lowry . | |
| D. 302,207 | 7/1989 | Matkovich | D24/230 |
| D. 337,165 | 7/1993 | Malinoff | D24/227 |
| 3,388,807 | 6/1968 | Emmitt | 206/443 X |
| 3,494,201 | 2/1970 | Roach . | |
| 3,853,217 | 12/1974 | Scordato et al. . | |
| 3,937,322 | 2/1976 | Cohen . | |
| 4,012,288 | 3/1977 | Lyman et al. . | |
| 4,235,338 | 11/1980 | Dugan et al. . | |
| 4,292,273 | 9/1981 | Butz et al. . | |
| 4,349,109 | 9/1982 | Scordato et al. . | |
| 4,349,632 | 9/1982 | Lyman et al. . | |
| 4,495,289 | 1/1985 | Lyman et al. . | |
| 4,577,760 | 3/1986 | Rainin et al. | 206/486 X |
| 4,626,509 | 12/1986 | Lyman . | |
| 4,676,377 | 6/1987 | Rainin et al. | 206/508 |
| 4,761,378 | 8/1988 | Godsey | 422/102 X |
| 4,948,442 | 8/1990 | Manns | 156/73.1 |
| 5,324,482 | 6/1994 | Scaramella et al. | 422/100 |
| 5,366,088 | 11/1994 | Hill et al. | 206/486 X |
| 5,392,914 | 2/1995 | Lemieux et al. . | |
| 5,441,702 | 8/1995 | Lemieux et al. | 422/100 |
| 5,470,538 | 11/1995 | Lind . | |
| 5,487,872 | 1/1996 | Hafeman et al. | 422/102 |
| 5,487,997 | 1/1996 | Stolp | 422/100 X |
| 5,622,676 | 4/1997 | Lind | 422/104 |
| 5,630,988 | 5/1997 | Stolp | 422/100 |
| 5,642,816 | 7/1997 | Kelly et al. | 211/74 X |
| 5,779,984 | 7/1998 | Kelly et al. | 422/104 |

*Primary Examiner*—Bryon P. Gehman
*Attorney, Agent, or Firm*—Wolf, Greenfield & Sacks, P.C.

[57] ABSTRACT

An improved pipette tip support rack having a honeycomb structure. The rack includes an array of interconnected sleeves, each of the sleeves being constructed to support a pipette tip therein. The sleeves are connected by bridges which form along abutting, touching surfaces thereof, or which extend between non-touching sleeves. Openings are formed between adjacent ones of said sleeve which occupy substantially all of the space between adjacent sleeves not occupied by the bridges. Inwardly extending lips on the interior of each sleeve support the enlarged portion of the pipette tip and provide a channel through which the stem extends. Interior side walls of each sleeve provide lateral support to the pipette tips. The tray may be used in conjunction with a container to provide ventilation during autoclaving. The tray snaps into the container and rests on shoulders therein. A finger tab is provided for lifting the tray out of the container.

23 Claims, 3 Drawing Sheets

PIPETTE TIP RACK WITH ARRAY OF INTERCONNECTED SLEEVES

FIELD OF THE INVENTION

This invention relates generally to racks for disposable pipette tips and more particularly to a pipette tip tray which is easily insertable into and removable from a container and which provides improved ventilation and pipette tip support.

BACKGROUND OF THE INVENTION

Disposable pipette tips often are packaged in supporting trays that function to organize the tips and to aid in the placement of a tip or a plurality of tips on a pipetter. Some prior art pipette tip trays have an open bottom and an open top, while others are supported within an enclosed container. Placing the tray within a container having a lid is preferable, since such an arrangement permits the pipette tips to be supported and organized for use in the same container in which they are shipped and in which they may be autoclaved. During autoclaving, the lid of the container may be tilted or removed entirely to allow circulation of ambient gasses to the pipette tips within the interior of the container. Alternatively, the lid of the container may be realigned to provide a gap between the lid and the sides of the container to allow gasses to circulate into the interior of the container. Vents provided in the tray allow the gasses to circulate throughout the container on both sides of the tray during the autoclaving process. An example of such a prior art structure is found in U.S. Pat. No. 4,676,377.

After the autoclaving process has been completed, the lid is closed on the container to prevent contamination of the pipette tips from dust, moisture and other airborne contaminants. The container may now be used for shipment or storage of the pipette tips in a sterilized condition.

Some prior art pipette tip trays used with a container either cannot be removed from the container, or are very difficult to remove. The inability to remove the tray from the container or the difficulty encountered in removing the tray prevents easy movement of the tray and pipette tips from the container to another support structure, and makes it difficult to sterilize and reuse the containers. Moreover, in many existing container-supported trays, there is insufficient circulation of the ambient gasses from the top of the tray to the lower portion of the tray within the container to provide adequate sterilization of the pipette tips during the autoclaving process. Finally, some pipette tip trays provide insufficient lateral support for the pipette tips disposed therein to avoid misalignment during use of a pipetter.

Therefore, it would be desirable to have a container-supported pipette tip tray which provided increased ventilation between the upper and lower portions of the tray while still providing a rigid support for the pipette tips. Moreover, it would be desirable to be able to easily remove and/or replace the trays in the containers. Finally, it would also be desirable to provide increased lateral support for the tips within the tray, particularly when using a multi-channel pipetter.

SUMMARY OF THE INVENTION

The foregoing drawbacks of existing containerized pipette tip trays and racks are overcome by the pipette tip tray of the present invention which provides increased ventilation through the tray while still providing the same level of structural support for the pipette tips. Moreover, the tray of the present invention can be easily inserted into and removed from the container by the user. In addition, the pipette tip tray of the present invention provides increased lateral support for the pipette tips.

According to one aspect of the present invention, a pipette tip tray is provided having a honeycombed configuration. In this configuration, the tray comprises a plurality of annular sleeves joined along bridging sections in which the non-bridging sections between sleeves are substantially open so that gasses are permitted to pass through the tray. The centers of each sleeve are spaced a distance which is compatible with the spacing on a pipetter with which the tray is to be used, and which allows for a wall thickness for the sleeves sufficient to provide the desired structural support. Each sleeve is joined to each adjacent sleeve along the bridging sections, which typically extend through the thickness of the tray and which typically are formed on abutting surfaces of the sleeves. In addition, preferably, a perimeter reinforcing strip is provided on the tray. The reinforcing strip around the perimeter of the tray, and the bridging sections joining each sleeve along the entire thickness of the tray provide the desired structural strength and rigidity to the tray.

In another aspect of the present invention, each sleeve includes on an interior surface thereof a projecting lip which extends inwardly toward the central axis of the sleeve. The pipette tip sits on this lip. The spacing between inwardly facing edges of the lip is greater than the outer diameter of the stem of the tip, but is less than the diameter of the upper portion of the tip so that the upper portion of the tip will seat on the lip, while the stem passes therethrough. The upper portion of the pipette tip sits partially within the sleeve so that the side walls of the sleeve provide lateral support for the upper portion of the pipette tip. Preferably, the inner diameter of the sleeve is just slightly greater than the outer diameter of the upper portion of the pipette tip, so that the upper portion of the tip sits snugly within the sleeve to prevent substantial lateral movement of the tip within the sleeve to stabilize the location and spacing of the tips on the tray.

In yet another aspect of the present invention, the pipette tip tray is easily removable from the container, and sits on shoulders on the inside surface of the container. Projections are provided around the perimeter of the tray which are designed to extend into previously formed slots on the interior surface of the container just above the shoulders which support the tray. The tray snaps into and out of these slots. A finger tab is provided on the tray for being grasped by the user's finger for lifting of the tray out of the container. This feature permits the container to be refilled with a new tray and fresh pipette tips.

In other aspects of the invention, a combination of a pipette tip tray and container with a pivoting lid are provided in which a finger tab and projections on the tray are used to snap the tray into and out of the container. A honeycombed tray structure provides increased ventilation within the container. The honeycomb structure of the tray comprises interconnected sleeves with openings therebetween. The sleeves have lips in which the tips seat and side walls to provide lateral support to the tips. In other aspects, gussets are provided in the corners of the lid, and beveled surfaces are provided around the lower edges of the lid for providing a tight fit between the lid and the container side walls during transportation and storage.

BRIEF DESCRIPTION OF THE DRAWINGS

The objects, advantages and features of this invention will be more clearly appreciated from the following detailed description when taken in conjunction with the accompanying drawings in which.

DETAILED DESCRIPTION

Figure 1:
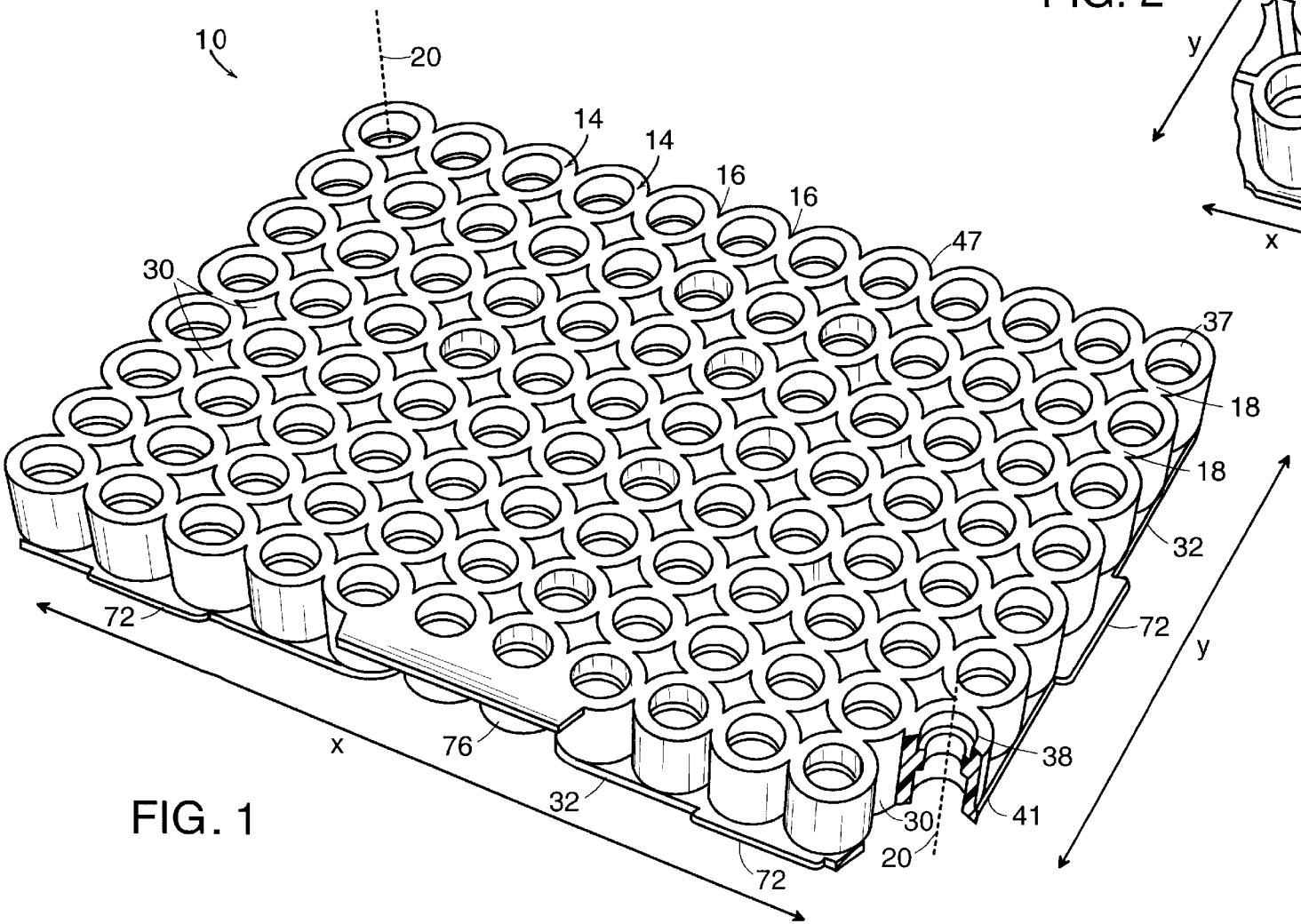
FIG. 1 is a partially cutaway, perspective view showing the pipette tip tray of the present invention.

With reference to the drawings, and more particularly to FIG. 1 thereof, the improved pipette tip tray of this invention will now be described. Tray 10 of this invention is formed of an array of sleeves 14 each having a generally annular cross-sectional configuration, and a central axis 20. Each sleeve 14 is joined to each sleeve 14 adjacent thereto by a bridge or bridge section 16 or 18. The number of sleeves 14 in each row and column depends upon the size of tray 10 and upon the size of the pipette tips 28 (FIG. 4) with which the tray 10 is to be used. One typical example is a tray 4.25 inches long and 2.83 inches wide having 12 sleeves in the long or X direction and 8 sleeves in the short or Y direction, as shown in FIG. 1.

Figure 2:
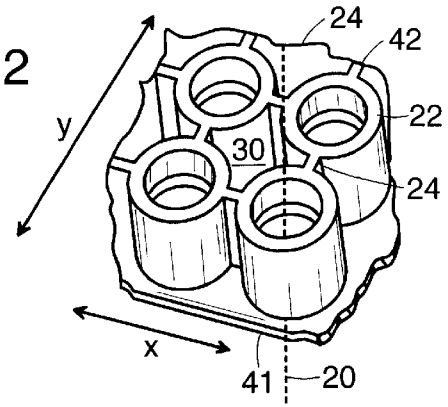
FIG. 2 is a partial, perspective view illustrating an alternative of the pipette tip tray of FIG. 1.

As shown in FIG. 1, in one embodiment, each sleeve 14 abuts each of the other sleeves 14 adjacent thereto in the array of sleeves. Bridge 16 or 18 is formed along the line or surface generated by contact between the outer, cylindrical surfaces of adjacent sleeves 14. For example, a sleeve 14 in the center of the array, is joined to a sleeve on each side thereof in the X-direction as shown in FIG. 1, by a bridge 16 and to a sleeve 14 on each side thereof in the Y-direction by a bridge 18. Typically, the X and Y directions, or the rows and columns respectively, of the array of sleeves 14 are perpendicular to one another, although they need not be. Preferably, each bridge 16 and 18 extends in a direction parallel to axis 20 through the entire thickness of tray 10 from a top surface 42 to a bottom surface 41, and is defined by the locus of points along which adjacent sleeves intersect one another or touch one another along abutting surfaces. Bridges 16 or 18 may comprise touching, intersecting or overlapping portions of adjacent sleeves 14, where adjacent sleeves touch one another, or bridges 16 or 18 may comprise elements separate from adjacent sleeves 14, where sleeves 14 are spaced from one another, as shown in FIG. 2. In one embodiment, bridges 16 are all aligned in each row in the X-direction with one another and with the centers of each sleeve as defined by the axis 20 thereof. Similarly, bridges 18 are all aligned in each column in the Y-direction with one another and with the axes 20 of each sleeve 14. However, it will be appreciated that bridges 16 and 18 could be aligned along lines that form an angle with respect to the X and Y directions as shown in FIG. 1, such as along a diagonal, at 45° to the X and Y directions, or that are not perpendicular to one another.

It will also be appreciated that adjacent sleeves 14 need not abut one another, but could be spaced from one another, as illustrated in FIG. 2, in which like numbers are used for like parts. Adjacent sleeves 22 of FIG. 2 are joined by extended bridges or bridge sections 24. In this alternative embodiment, bridges 24 need only be so thick in directions perpendicular and parallel to the central axis 20 of sleeves 22 that sufficient strength and rigidity is imparted to the tray 10 to prevent breaking thereof under normal use, and to provide the rigid support necessary for pipettes 28 residing within sleeves 22.

In either the embodiment of FIG. 1 or that of FIG. 2, openings 30 are disposed between sleeves 14 or 22. Preferably, openings 30 extend over all of the space between adjacent sleeves 14 or 22 which is not occupied by respective bridges 16 and 18 or 24. Openings 30 extend from the top surface 42 to the bottom surface 41 of tray 10 in a direction parallel to axis 20 to permit the free flow of gases from one side of tray 10 to the other side, even if the sleeves 14 or 22 are completely filled with pipette tips 28. In the embodiment of FIG. 1 for an array of sleeves 14 which are aligned along perpendicular X and Y axes, openings 30 are disposed in the spaces between diagonally aligned sleeves 14. Typically, openings 30 have the shape of a quadrilateral, preferably an equilateral quadrilateral and most preferably an astroid. In the embodiment of FIG. 2, preferably openings 30 occupy all the space between adjacent sleeves 22 not occupied by bridges 24 and typically are symmetrical about the X and Y axes or have the same length and shape along each of an X and Y axis, as shown in FIG. 2. Openings 30 are preferably as large as permitted by the strength and rigidity requirements of tray 10 to maximize the ventilation through tray 10.

Figure 3:
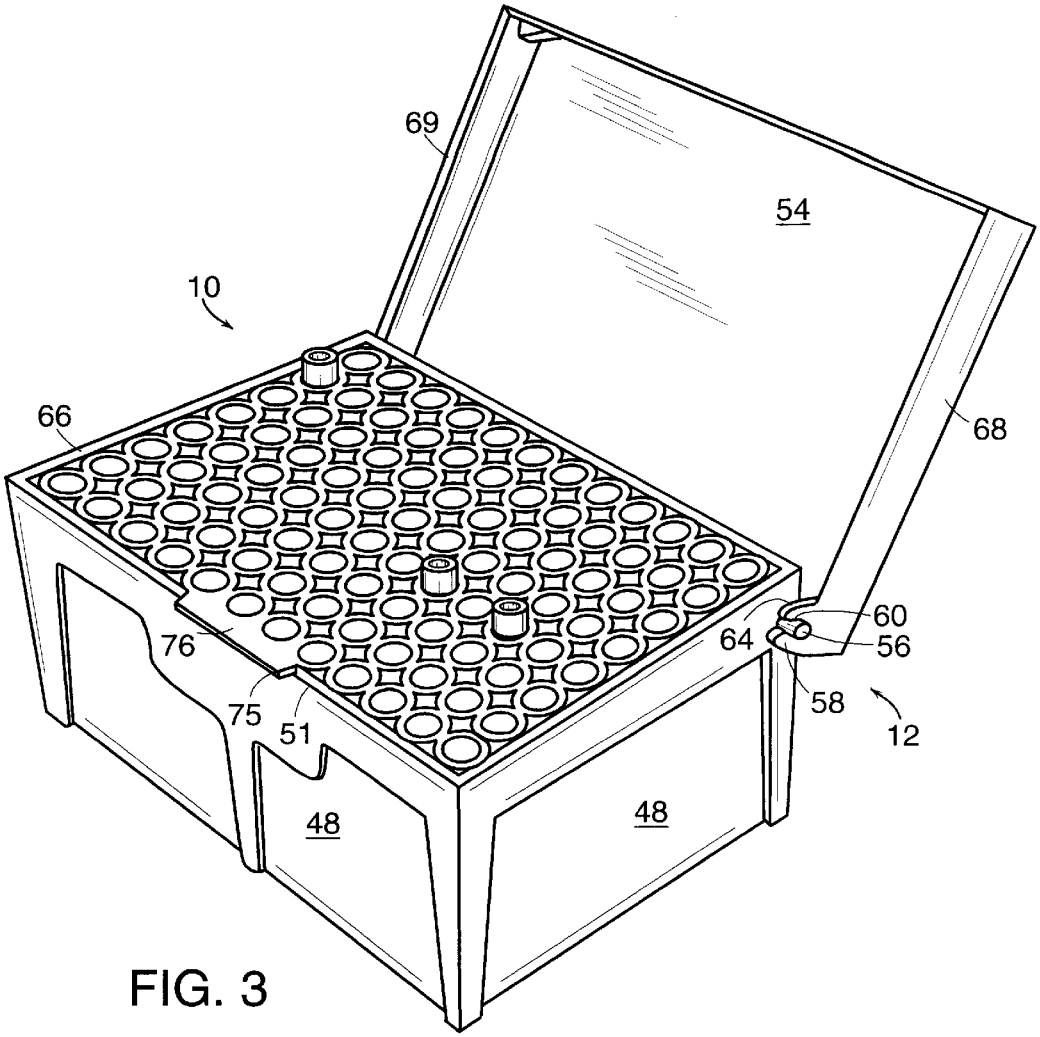
FIG. 3 is a perspective view showing the pipette tip tray of this invention with a container.
Figure 5:
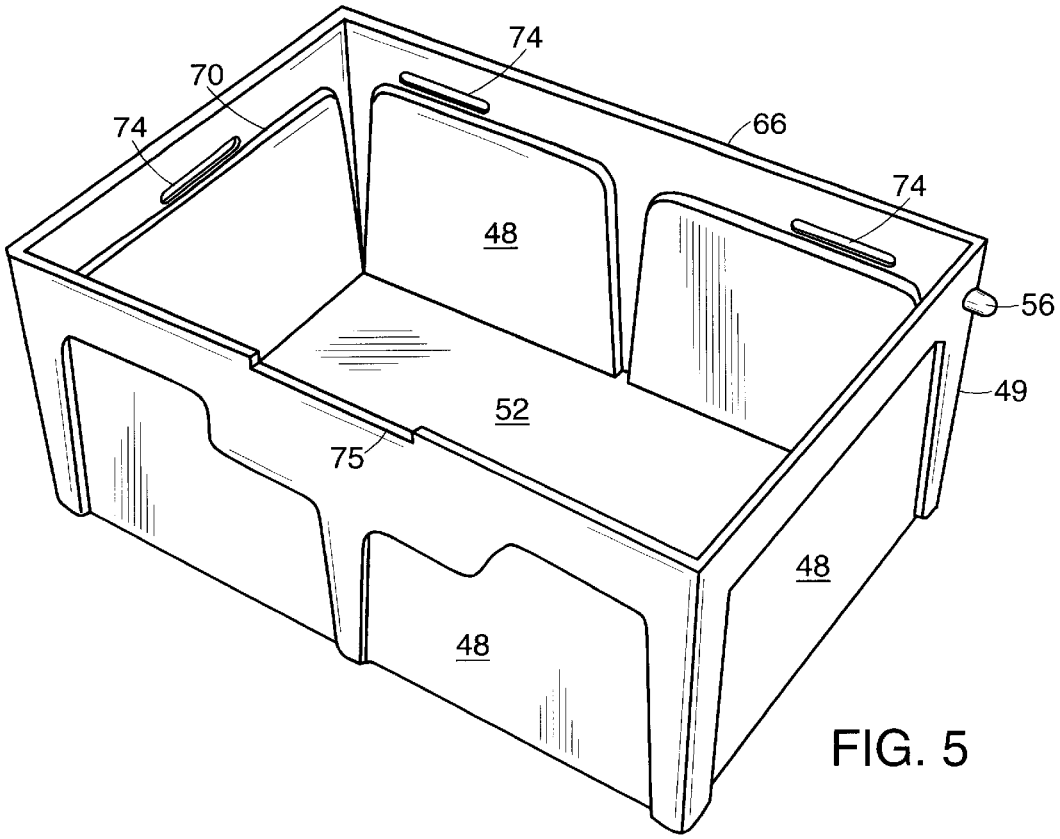
FIG. 5 is a perspective view of the container used with the pipette tip tray of FIG. 1.

As shown in FIGS. 3 and 5, in a typical environment, tray 10 is supported within a container 12. Container 12 of FIG. 3 is illustrative of one type of container with which tray 10 may be used. While tray 10 is shown used in conjunction with container 12, it is to be understood that tray 10 may be used in conjunction with various different types, sizes and shapes of pipette tip containers, and the particular container 12 disclosed herein is shown for purposes of illustration only. Tray 10 may be used with any other type of container in which it is desired to provide ventilation for autoclaving purposes or otherwise, in which it is desired to be able to easily remove or replace the tray in the container, and in which a more stable support for the pipette tips is desired.

Container 12 typically is rectangular in configuration, as is tray 10. Upper edges 66 of side walls 48 define an opening of container 12. Typically, this opening has the same size and shape as the tray 10 defined by its outer perimeter so that tray 10 fits snugly within container 12. Container 12 includes four side walls 48 joined to a bottom wall 52. A lid 54 is pivotally mounted on container 12 about pegs 56 disposed on opposed side walls 48 adjacent back edge 49. Typically, although not necessarily, lid 54 is affixed to each peg 56 by a pair of spaced, projecting arms 58. Opening 60, disposed in the space between arms 58, typically has a keyhole configuration which is narrower at a throat section spaced from the distal ends of arms 58 and wider at larger portion where peg 56 seats within opening 60. Spaced arms 58 typically are formed of a resilient material such that peg 56 may be forced between the distal ends 64 of arms 58, past the throat and into the larger portion of opening 60 by urging apart the distal ends 64 of arms 58. Typically, although not necessarily, the distal ends 64 of arms 58 are beveled to form a wider opening to receive peg 56 and to facilitate its passage through the throat. In this embodiment, lid 54 may be lifted from container 12 simply by an upward force which urges apart arms 58 apart to release peg 56 from opening 60.

Typically, although not necessarily, lid 54 includes a gusset 64 in each corner to provide a dust and dirt free seal at the corners when lid 54 is seated on the upper edges 66 of side walls 48. Also, front gussets 64 support and position lid 54 on the edges 66. Gussets 64 protect the pegs 56 from breakage during shipping. Lower edges 69 of the side walls 68 of lid 54 are beveled to facilitate the closure of side walls 68 of lid 54 over the upper edges 66 of walls 48 and to provide a dust-and dirt-free seal between side walls 68 and edges 66.

Disposed on the inner surfaces of container side walls 48 are shoulders 70 that support tray 10 within container 12. Tray 10 also includes projections 72 along its outer perimeter which are adapted to extend into correspondingly formed and positioned recesses 74 that are formed in side walls 48 and that are disposed just above shoulders 70. Typically, recesses 74 are positioned so that when projections 72 extend therein, the lower surface 41 of tray 10 rests on shoulders 70. Container 12 typically is formed of a material, such as plastic, which allows some flexing of side walls 48. In this manner, rack 10 may be snapped into place in container 12 by urging projections 72 downwardly along side walls 48 until projections 72 are in registration with recesses 74 at which point projections 72 snap into place in associated recesses 74 as side walls 48 return to their preexisting position.

Typically, although not necessarily, the perimeter of the rack 10 includes a reinforcing rim 32 extending around at least a portion of and preferably substantially all of the entire outer perimeter of tray 10. Rim 32 typically occupies spaces between adjacent sleeves 14 around the outer perimeter of tray 10. Rim 22 may have the same configuration and size as the opening of container 12 defined by upper edges 66 so that tray 10 fits snugly within container 12.

Figure 4:
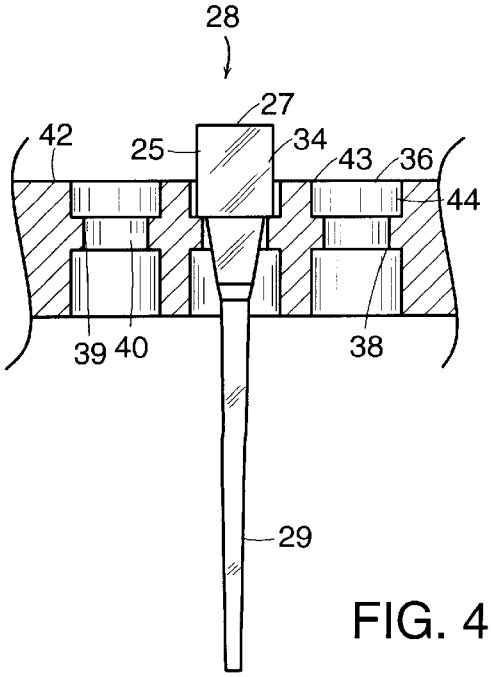
FIG. 4 is a partial, cross-sectional side view of the tray of FIG. 1 with a pipette tip.

Pipette tips 28 which may be used with tray 10 will now be described with reference to FIG. 4. Tips 28 typically include an enlarged upper portion 25 having an opening 27, and a stem 29. The cross-sectional configuration of each tip is typically circular. As can be seen in FIG. 4, each tip typically is tapered from opening 27 to distal end of stem 29. In one embodiment, each pipette tip 28 includes a shoulder 34 which is formed on the lower end of enlarged portion 25 and which extends around the outer circumference of the tip intermediate opening 27 and the distal end of stem 29.

As shown in FIGS. 1 and 4, each sleeve 14 includes cylindrical interior surfaces 36 which define an inner chamber 37. A tip support lip 38 extends inwardly from surfaces 36 toward axis 20 and typically is of uniform radial dimension or spacing from surfaces 36 around the entire circumference of inner surfaces 36. Inwardly facing edges 39 of lip 38 define a central opening 40 through which the stem 29 of the pipette tip may pass. In the embodiment described above in which each tip 28 includes a shoulder 34, opening 40 is smaller in diameter than the diameter of tip 28 at shoulder 34 so that shoulder 34 rests on lip 38 to support tip 28 and prevent it from falling through opening 40. In this manner, each tip 28 is supported such that opening 27 is disposed a predetermined distance above upper edge 43 of sleeve 14 and so that the lower end of stem 29 is supported a known distance above bottom wall 52 of container 12 to maintain the sterilized and dirt free condition of the pipette tips.

In a preferred embodiment, lips 38 are formed by preparing countersunk holes within sleeves 14. However, it will be appreciated that lips 38 may be formed in any other manner known to those of ordinary skill in the art.

In another aspect of the invention, the upper portion of each sleeve 14 forms a support ring 44 for enlarged portion 25 of tips 28. Each ring 44 extends a sufficient distance above lips 38 such that when a tip 28 is seated on lip 38, opening 27 is disposed slightly above the upper edge 43 of ring 44. A typical example of this spacing is about 0.13 inches. Preferably, the inner diameter of ring 44 (i.e. inner surfaces 36) is about equal to or slightly greater than the outer diameter of opening 27 of tip 28. Thus, the upper portion 25 of each tip 28 resides snugly within ring 44. In this manner, ring 44 provides lateral support to tips 28 to prevent significant lateral movement thereof in the X or Y directions (FIG. 1) during storage, movement, autoclaving or use with a pipetter. Since the pipette tips 28 do not move during use with the pipetter, and since this precise spacing is thus maintained, the use of the pipetter is facilitated. While it is desired that the inner diameter of rings 44 be configured to be close to the outer diameter of the opening 27 of tips 28, it is understood that the inner diameter of rings 44 may be somewhat larger than the outer diameter of openings 27 if some lateral movement of the tips may be tolerated. In either event, lateral movement of the tips will be minimized, and once any vibrations of the container have subsided or movement of the container is reduced, the tips will settle into the desired, centered position within sleeves 14.

It is sometimes desired to reuse container 12 with a new tray 10 and associated new tips 28. Therefore, it is desirable to be able to remove tray 10 from container 12 and insert a new, filled tray 10. For this purpose, in another aspect of the invention, tray 10 includes a finger tab 76 which extends from tray 10 on one side thereof. Typically, finger tab 76 seats in a correspondingly shaped cutout 75 along an upper edge 66 of a wall 48 when tray 10 is snapped into place within container 12. The outer edge of tab 76 is preferably about flush with the outer surface of wall 48. In this manner, tab 76 does not interfere with the seal created between side walls 68 and upper edges 66. Tab 76 preferably extends outwardly away from sleeves 14 along or adjacent upper edges 43 of tray 10 sufficiently that tab 76 may be grabbed by a user's finger and lifted upwardly to snap tray 10 out of container 12 by forcing projections 72 out of associated recesses 74 by flexing of side walls 48. Typically, finger tab 76 and cutout 75 are disposed along a front edge 51 opposite back edge 49 adjacent to which the pegs 56 are mounted. In this manner, as lid 54 is hinged into an open position about pegs 56, finger tab 76 is exposed along front edge 51 spaced from lid 54 so that tab 76 may be freely and unimpededly engaged by the finger of the user for lifting of tray 10 out of container 12.

Figure 6:
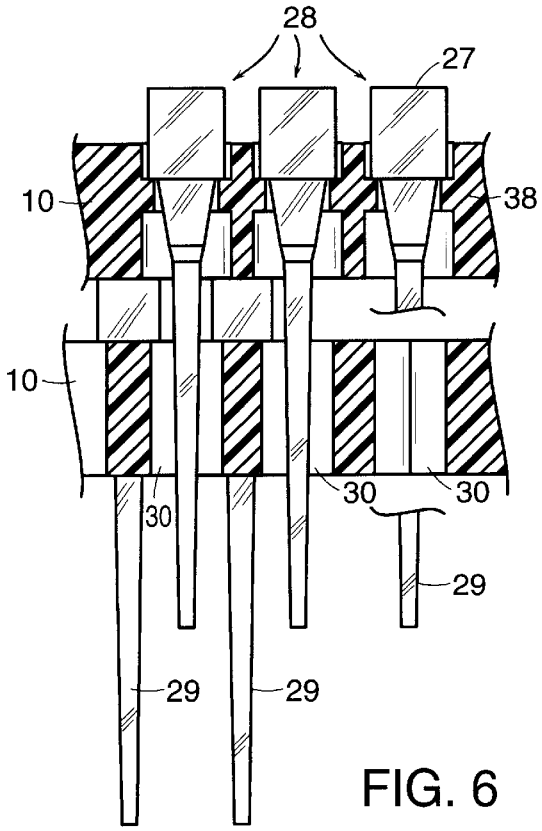
FIG. 6 is a partial, cross-sectional view of the tray of the present invention filled with tips and stacked on another tray.

If container 12 is to be reused, it is desired to store in another location replacement trays 10 filled with tips 28. Preferably, filled replacement trays 10 are stacked one upon the other to reduce storage requirements. With some types of tips 28, the trays 10 are not easily stacked, because the stems 29 of one tip 28 do not readily seat into an opening 27 of a tip therebelow. The present invention overcomes this problem, since trays 10 may be stacked one on top of the other by offsetting each tray with respect to the tray below, as shown in FIG. 6, so that the stems 29 of each tip 28 extend into a corresponding opening 30 between sleeves 14 therebelow. In this manner, the filled trays are readily stacked, even if the tips do not lend themselves to stacking.

In use, a replacement tray 10 is snapped into place on shoulders 70 in container 12. Tray 10 contains pipette tips 28 placed in each sleeve 14, substantially as shown in FIG. 3, so that the tips seat on lips 38 and stems 29 extend through openings 40. The upper portion 25 of each tip 28 is encircled by ring 44. Lid 54 is attached by snapping arms 58 onto pegs 56 so that pegs 56 reside within opening 60. Thereafter, lid 54 is closed by pivoting it about pegs 56 so that side walls 68 seal edges 66 of side walls 48 and so that gussets 64 rest on edges 66. The pipette tips may be shipped or stored in this configuration. When it is desired to autoclave the pipette tips 28, lid 54 may be opened or removed entirely to allow gasses to enter container 12. During the autoclaving process, the gasses will pass through openings 30 in tray 10 from a chamber above tray 10 to a chamber below tray 10 but above bottom wall 52 to fully sterilize both the stems 27 and the upper portions 25 of the pipette tips. When the autoclaving process has been completed, lid 54 may be reattached and/or pivoted into a closed position to again seal container 12 to maintain the sterilized condition of the pipette tips.

During use with a pipetter, the spacing in the pipetter can be adjusted to be identical to that between openings 27 of tips 28, or a multichannel pipetter is selected with the spacing between openings 27 of tips 28. Alternatively, a single channel pipetter is used. The provision of lips 38 ensures that each tip is supported in exactly the same position within each sleeve 14 so that all openings 27 are aligned in generally the same plane which is generally parallel to the upper surface 42 of rack 10, and so that each tip 28 is centered in its associated sleeve 14, thus facilitating use of a multichannel pipetter.

If it is ever desired to remove tray 10 from container 12 and replace it with another, the user, with a finger, lifts tab 76 upwardly out of cutout 75 to force projections 72 out of associated recesses 74 as walls 48 flex outwardly. Typically, the projections 72 along back edge 49 will remain in associated recesses 74 as the projections 72 disposed along walls 48 disposed at a 90° angle with respect to back edge 49 and along front edge 51 rise out of associated recesses 74. Thereafter, the user simply withdraws projections 72 from associated recesses 74 along the back edge 49.

Typically, tray 10 is injection-molded and formed of a plastic material. A typical example of the material of which tray 10 may be formed is polypropylene. However, it will be appreciated that tray 10 may be formed of any other material, such as aluminum, which can be autoclaved and which provides the desired structural support and rigidity. Container 12 typically is formed of the same material as tray 10 and also is molded, although it will again be appreciated that other materials and techniques may be used to form container 12. Lid 54 also is typically formed of a plastic material and may be molded or otherwise formed in a manner well-known to those skilled in the art.

The foregoing pipette tip tray provides the ventilation desired during an autoclaving process when mounted within a container, provides the desired lateral stability to the pipette tips and can be readily removed from and inserted into a container.

Modifications and improvements will occur within the scope of this invention to those skilled in the art, and the above description is intended to be exemplary only. The scope of this invention is defined only by the following claims and their equivalents.

We claim:

1. A pipette tip support tray comprising:

an array of interconnected, generally annular sleeves each having a central axis, the axes of said sleeves being generally parallel to one another;

bridge sections interconnecting adjacent ones of said sleeves; and openings disposed between one of said sleeves, and others of said sleeves adjacent thereto, said openings occupying substantially all space between the one sleeve and the other adjacent sleeves, except that occupied by said bridge sections.

2. The pipette tip support tray as recited in claim wherein each of said sleeves comprises:

an upper rim;

a lower rim;

a lip extending radially inwardly toward said axis intermediate said upper rim and said lower rim for supporting a pipette tip.

3. The pipette tip support as recited in claim 2 further comprising interior walls on each side of said sleeves between said lip and said upper rim for providing lateral support to pipette tips disposed therein to reduce lateral movement of pipette tips in a direction generally perpendicular to a sleeve axis.

4. The pipette tip support tray as recited in claim 1 further comprising a reinforcing rim disposed about an exterior perimeter of said tray.

5. The pipette tip support tray as recited in claim 1 further comprising a tab extending from one side of said tray for being engaged by finger to lift said tray out of a container.

6. A combination comprising:

a pipette tip support tray comprising an array of interconnected sleeves each having a generally annular cross-sectional configuration and a central axis, each sleeve having interior sidewalls, an upper rim and a lower rim, each sleeve having a lip disposed on said interior side walls extending inwardly toward said central axis of said sleeve; and at least one pipette tip having an enlarged upper portion with an opening and a lower stem, said at least one pipette tip being disposed in one of said sleeves, said upper portion of said at least one pipette tip resting on said lip of said one of said sleeves such that at least a portion of said upper portion of said at least one pipette tip is enclosed and supported against lateral movement by side walls of said one of said sleeves disposed between said lip and said upper rim of said one of said sleeves.

7. The combination as recited in claim 6 wherein said tray further comprises bridge sections interconnecting adjacent ones of said sleeves.

8. The combination as recited in claim 6 wherein said tray further comprises openings disposed between adjacent ones of said sleeves, said openings occupying substantially all the space between adjacent ones of said sleeves, except for that occupied by said bridge sections.

9. Apparatus for supporting pipette tips comprising:

a container having a bottom wall and side walls connected to and extending from said bottom wall, each of said side walls terminating in an associated top rim, the associated top rim of each of said side walls having a length extending between two adjacent side walls;

a pipette tip support tray supported within said container; and a finger tab extending from one edge of said tray into an associated rim of one of said side walls for being grasped by a finger for urging said tray out of said container, said finger tab extending along said associated rim of said one of said side walls a distance less than the length of said associated rim of said one of said side walls.

10. The apparatus as recited in claim 9 wherein said finger tab resides in a cutout formed on said rim of said one of said side walls.

11. The apparatus as recited in claim 9 further comprising:

shoulders disposed on said side walls of said container for supporting said tray; and a cover mounted onto said side walls of said container for forming an enclosure when said cover is in a closed condition in which it engages said associated top rims of each of said side walls.

12. The apparatus as recited in claim 9 further comprising:

projections extending from a perimeter of said tray toward adjacent side walls of said container; and recesses disposed in said adjacent side walls of said container, each recess being aligned with a projection and being configured to receive an aligned projection to retain said tray within said container.

13. The apparatus as recited in claim 12 wherein said finger tab is disposed on a side of said tray having no projections.

14. The apparatus as recited in claim 9 wherein said tray is formed of interconnected sleeves.

15. The apparatus as recited in claim 14 further comprising openings between adjacent ones of said sleeves and wherein said openings comprise substantially all of the space between adjacent sleeves.

16. The apparatus as recited in claim 14 wherein each of said sleeves comprises:

inner side walls;

an upper rim and a lower rim;

a lip disposed intermediate said upper and lower rims and extending inwardly from said inner side walls toward a central axis, inwardly facing surfaces of said lip being spaced from each other to provide a passage therebetween for receiving a stem of a pipette tip; and upper portions of said inner side walls of said sleeve between said upper rim and said lip providing lateral support to pipette tips disposed in said sleeve to minimize lateral movement thereof.

17. A pipette tip support tray comprising:

an array of interconnected, generally annular sleeves, each sleeve having a central axis extending along a direction of elongation thereof;

a support lip disposed within each sleeve for supporting a pipette tip in an axial direction; and a support ring disposed on an upper portion of each sleeve for surrounding a pipette tip and for providing lateral support to a pipette tip in a direction generally perpendicular to the axis of the sleeve.

18. A pipette tip support tray comprising:

an array of interconnected, generally parallel sleeves;

bridge sections interconnecting adjacent ones of said sleeves; and openings disposed between one of said sleeves and others of said sleeves adjacent thereto, said openings occupying substantially all space between said one sleeve and said others of said sleeves adjacent thereto, except that occupied by said bridge sections.

19. The pipette tip support tray as recited in claim 18 wherein each of said sleeves comprises:

an upper rim;

a lower rim;

interior walls facing a central opening;

a lip extending inwardly from said interior walls toward the central opening intermediate said upper rim and said lower rim for supporting a pipette tip.

20. The pipette tip support tray as recited in claim 19 wherein said interior walls between said lip and said upper rim provide lateral support to pipette tips disposed therein to reduce lateral movement of pipette tips.

21. Apparatus for supporting pipette tips comprising:

a container having a bottom wall and side walls connected to and extending from said bottom wall, each of said side walls terminating in an associated top rim;

a pipette tip support tray supported within said container;

projections extending from a perimeter of said tray toward adjacent side walls of said container;

recesses disposed in said adjacent side walls of said container, each recess being aligned with a projection and being configured to receive an aligned projection to retain said tray within said container; and a finger tab extending from one edge of said tray into an associated rim of one of said side walls for being grasped by a finger for urging said tray out of said container, said finger tab being disposed on a side of said tray having no projections.

22. Apparatus for supporting pipette tips comprising:

a container having a bottom wall and side walls connected to and extending from said bottom wall, each of said side walls terminating in an associated top rim;

a pipette tip support tray supported within said container, said tray being formed of interconnected sleeves;

openings disposed between adjacent ones of said sleeves, said openings comprising substantially all of the space between adjacent ones of said sleeves; and a finger tab extending from one edge of said tray into an associated rim of one of said side walls for being grasped by a finger for urging said tray out of said container.

23. Apparatus for supporting pipette tips comprising:

a container having a bottom wall and side walls connected to and extending from said bottom wall, each of said side walls terminating in an associated top rim;

a pipette tip support tray supported within said container, said tray being formed of interconnected sleeves, each of said sleeves comprising:

inner side walls;

an upper rim and a lower rim;

a lip disposed intermediate said upper and lower rims and extending inwardly from said inner side walls toward a central axis, inwardly facing surfaces of said lip being spaced from each other to provide a passage therebetween for receiving a stem of a pipette tip; and upper portions of said inner side walls of said sleeve between said upper rim and said lip providing lateral support to a pipette tip disposed therein to minimize lateral movement thereof; and a finger tab extending from one edge of said tray into an associated rim of one of said side walls for being grasped by a finger for urging said tray out of said container.

* * * * *